US006526328B1

(12) United States Patent
Maguin et al.

(10) Patent No.: US 6,526,328 B1
(45) Date of Patent: Feb. 25, 2003

(54) PROCESS FOR ROLLING A METAL PRODUCT

(75) Inventors: Nicolas Maguin, Montreuil (FR); Yves Leclercq, L'Etang la Ville (FR); Hervé Biausser, Paris (FR); Alireza Arbab, Valenciennes (FR)

(73) Assignee: Vai Clecim, Courbevoie (FR)

( * ) Notice: Subject to any disclaimer, the term of this patent is extended or adjusted under 35 U.S.C. 154(b) by 0 days.

(21) Appl. No.: 09/399,170

(22) Filed: Sep. 20, 1999

(30) Foreign Application Priority Data

Sep. 21, 1998 (FR) ..... 98 11761

(51) Int. Cl.[7] ..... G06F 19/00

(52) U.S. Cl. ..... 700/148; 700/150; 700/155

(58) Field of Search ..... 700/148, 150, 700/155; 72/365.2, 366.2; 29/888.073; 228/117, 158

(56) References Cited

U.S. PATENT DOCUMENTS

| | | | | |
|---|---|---|---|---|
| 4,617,817 A | * | 10/1986 | Gegal et al. | 72/364 |
| 4,658,362 A | * | 4/1987 | Bhatt | 700/145 |
| 4,861,535 A | * | 8/1989 | Due et al. | 264/103 |
| 4,982,417 A | * | 1/1991 | Kopineck et al. | 378/70 |
| 5,086,399 A | | 2/1992 | Tsugeno et al. | |
| 5,200,005 A | * | 4/1993 | Najah-zadeh et al. | 148/648 |
| 5,357,443 A | * | 10/1994 | Watanabe et al. | 700/147 |
| 5,881,594 A | * | 3/1999 | Hughes et al. | 72/364 |
| 5,966,682 A | * | 10/1999 | Gramckow et al. | 702/170 |
| 6,205,366 B1 | * | 3/2001 | Tang et al. | 700/97 |
| 6,430,461 B1 | * | 8/2002 | Andorfer et al. | 700/148 |

FOREIGN PATENT DOCUMENTS

| | | |
|---|---|---|
| JP | 2-137606 | 5/1990 |
| JP | 8-243619 | 9/1996 |
| WO | 93/11886 | 6/1993 |

OTHER PUBLICATIONS

C. Biegus et al, "Ermittlung von Werkstoffdaten zur Gefügesimulation" Stahl und Eisen, vol. 116, No. 5, May 20, 1996, pp. 43–49.

Patent Abstracts of Japan, vol. 008, No. 168 (C–236), 3 août 1984 & JP 59 067324 A (Kawasaki), Apr. 17, 1984.

Patent Abstracts of Japan, vol. 005, No. 203 (M–103), Dec. 23, 1981 & JP 56 119614 A (Kawasaki), Sep. 19, 1981.

G. Sörgel, Rechnergeführtes Thermomechanisches Walzen in Grobblechstrassen, Stahl & Eisen, vol. 107, No. 20, Oct. 5, 1987, pp. 921–926.

B. Petit et al, "La Reussite Epaisseur en Laminage a Chaud Associee Au Cedage et a La Mecanique Cage", Cahiers D'Informations Techniques De La Revue De Metallurgie, vol. 90, No. 10, Oct. 1, 1993, pp. 1255–1264.

Y. I. Kokovikhin, "Limiting Conditions of Drawing in Solid and Roller Dies", Steel in Translation, vol. 24, No. 12, Dec. 1, 1994, pp. 13–17.

* cited by examiner

*Primary Examiner*—Thomas Black
*Assistant Examiner*—Ronald D Hartman, Jr.
(74) *Attorney, Agent, or Firm*—Arent Fox Kintner Plotkin & Kahn, PLLC

(57) ABSTRACT

The invention relates to a process for rolling a metal product by successive passes into at least one roll stand associated with a calculation unit comprising a computer and a mathematical model for adjusting the rolling load applied by the clamping means. According to the invention, before each pass, the computer associated with the mathematical model determines a predictable variation value of the flow stress of the metal corresponding to the deformation to be realized in the pass considered, while taking into account the evolution, during the rolling operation, of the microcrystalline structure of the metal making up the product to be rolled, and the rolling load to be applied in order to achieve the requested reduction in thickness is calculated before each pass according to the value thus predicted for the flow stress and the evolution of the microcrystalline during the rolling operation.

19 Claims, 5 Drawing Sheets

PROCESS FOR ROLLING A METAL PRODUCT

BACKGROUND OF THE INVENTION

1. Field of the Invention

The invention relates to a process for rolling a metal product and applies more particularly to hot rolling of flat products such as slabs or bands originated from a shaping mill or from continuous casting.

2. Description of Related Art

Hot rolling usually takes place in successive rolling stages in a unit comprising one or several roll stands. Each roll stand can be used as a reversible mill performing a number of reducing passes, alternately in one direction and the other, until the desired thickness is achieved. But, a single rolling pass can be carried out in each stand. The unit operates then as a tandem mill, whereas the rolled product is taken simultaneously in all the stands and its thickness is reduced successively in each roll stand.

The invention applies especially to hot rolling of steels and their alloys, but can also be used, in certain conditions, for rolling non-ferrous metals such as aluminum and its alloys.

Generally, a mill comprises a rigid holding stand with two separate roll standards between which are provided at least two working rolls, superimposed, thus forming a gap enabling the product to be rolled to run through the said gap. In a conventional, so-called quarto arrangement, the working rolls rest each on a back-up roll of larger diameter. In a so-called sexto assembly, idling rolls are interposed between the working rolls and the back-up rolls.

At least the back-up rolls are fitted, at their ends, with journals rotating inside chocks that are mounted to slide into windows provided respectively on both standards of the stand, parallel to a clamping plane, generally vertical, passing more or less through the axes of the working rolls.

The mill is associated with means to control the running of the product between the rolls, at a certain forward speed. In the case of a reversible mill, which rolls alternately into two opposite directions, the forward control means consist, generally, of two roller tables, respectively, one roller table placed upstream of the stand, in the running direction, in order to control the engagement of the product and another roller table, placed downstream, in order to receive the product upon completion of the rolling operation.

In hot rolling, the product is heated, before rolling, up to a temperature of approx. 1200° C. in the case of steel, in order to facilitate deformation of the metal and its flow between the rolls. Generally, indeed, in a rolling process, the product exhibits at the inlet of the roll stand a thickness greater than the distance between the rolls and, when it contacts the said rolls, it is driven by a friction effect, then pinched between both rolls, whereas the metal continues flowing and being reduced in thickness, until a thickness more or less equal to the distance between the generatrices opposite both working rolls is achieved. Thus, a roll nip can be defined, delineated by the arcs of contact between each roll and the product.

Rolling, therefore, starts with a raw part such as a slab or a band of variable thickness, which may range between a few millimeters and several hundred millimeters and to each pass corresponds a reduction in thickness that may vary, for instance, from 50 mm to a few ten millimeters.

During rolling, the rolls tend to move away from one another and must therefore be held in place by an opposite roll load which, in a quarto mill, is applied to the chocks of the back-up rolls.

These clamping means are thus used, on the one hand, for prior adjustment of the distance between the rolls and, on the other hand, for maintaining the said distance during the roll pass. They generally consist of screws or hydraulic jacks mounted on the roll stand and resting respectively on both chocks of a back-up roll, whereas the other is blocked in its upward motion. However, other arrangements are possible. For instance, back-up rolls can be used, which comprise a shell mounted to rotate round a fixed shaft and resting on the said shaft via a series of jacks. These jacks then constitute clamping means exerting the rolling load, which is thus distributed over the whole length of the gap.

In all cases, under the effect of the rolling load, certain members of the roll stand will inevitably yield to some extent, thereby increasing slightly the distance between the rolls, which had been adjusted without any product, and therefore causes the crushing foreseen to be reduced. To realise accurately the requested reduction in thickness, the yielding value must be assessed, so that it can be compensated for as exactly as possible.

The rolling load to be applied for keeping a given distance between the rolls depends on how the product will be deformed in the nip between the rolls.

Conversely, the maximum reduction possible in thickness depends on the rolling load that can be applied, taking into account the capacities of the mill.

The reduction in thickness that can be achieved at each pass is therefore limited and this is why a raw product is rolled, normally, in several successive passes, each determining an elementary reduction in thickness, compatible with the capacity of the mill. The total reduction in thickness from a raw thickness $e_o$ down a final thickness $e_n$ can be achieved in n passes according to a progressive thickness reduction process, called a rolling scheme, which depends on the capacity of the mill and on the adjustment means available, on the mechanical and physical features of the roll stand and of the product, as well as the thickness and evenness tolerances to be adhered to.

According to the capacities of the unit available, a single rolling scheme can be defined in which, at each pass, the same average reduction in thickness is achieved. The number of passes to be carried depends then, simply, on the total reduction in thickness to be provided.

However, it may prove necessary to increase the number of passes since the selected average reduction in thickness must be determined so as to remain compatible, for all the passes, with the characteristics of the product and of the roll stand. Still, to improve the productivity, it obviously pays to reduce, as far as possible, the number of passes to be carried out.

But it has also appeared that the final quality of the product, and especially its evenness, depended on the conditions in which rolling is performed and that all the thickness reduction schemes are not equivalent when a product of a set quality should be achieved.

For example, even if a certain temperature of the product can be defined at the beginning of the rolling process, this temperature varies from one pass to the next. Indeed, the product cools down during the waiting time between two successive passes, but the deformation of metal causes, conversely, the product to be heated during the pass and it may prove necessary to cool the product down between two passes in order to prevent excessive cumulated heating.

Still, the deformation conditions of the product, which determine the rolling load to be exerted, depend obviously on the nature of the metal and its temperature.

It therefore seems judicious, in order to obtain a product with set qualities, to adhere to an optimum pattern that depends not only on the mechanical capacity of the installation, but also on the final quality requested for the product.

The last few years have witnessed attempts to automate the rolling process of a flat product enabling to achieve the thickness foreseen with good evenness and by using a minimum number of passes without overloading the roll stand(s).

In such a system, it is necessary to control, at each pass, the adjustment of the clamping means in order to apply between the working rolls, a rolling load enabling to realise the maximum reduction in thickness compatible with the capacity of the mill. This rolling load is assessed in relation to the different rolling parameters on which depend the running conditions of the metal in the chock, notably the reduction in thickness to be provided, the forward speed and the temperature of the product when entering the mill.

According to the practice known until now in the most sophisticated units, on the basis of global parameters such as, for instance the flow stress of a metal in relation to its grade and to its temperature, table of references of its rolling conditions, observed previously for a known steel, can be drawn in order to deduce the conditions to be adhered to when the same steel lies again in the production programme of a unit.

To this end, the predictable rolling load should be assessed in each case. However, this load can only be appraised globally on the basis of the observations made during previous rolling operations. Such an estimate is not accurate enough to adjust the rolling conditions during each pass so as to obtain effectively the optimum reduction in thickness and, in particular, compensate for the yielding effect.

BRIEF SUMMARY OF THE INVENTION

The invention remedies this shortcoming and suggests, thanks to improved modelling technology, a new process enabling to determine with greater accuracy the rolling load to be applied in order to follow a rolling scheme. Moreover, the invention enables to act automatically and in real time on the settings of the mill in order to modify the said settings at each pass in relation to the measurements taken during the previous pass, so that the rolling scheme can be adapted permanently while optimising the settings at each pass.

The invention therefore generally relates to a rolling process of a metal product in a unit comprising:

- a holding roll stand with two separate roll standards,
- at least two working rolls, superimposed between the standards of the roll stand,
- means to control the forward motion of the product during the rolling operation in a nip delineated by two arcs of contact of the product with both rolls, between an inlet section and an outlet section of the nip,
- clamping means resting, respectively, on the rolls and on the roll stand, for adjusting the distance between the working rolls corresponding to a reduction in thickness to be carried out and for maintaining the said distance during the roll pass, by applying, between the working rolls, a rolling load that depends on the mechanical and physical characteristics of the roll stand and of the product and on the flow conditions of the metal in the roll nip, and determines a yield effect of the various members of the stand tending to increase the said distance e,
- means for adjusting the said clamping means, controlled by a computer associated with a mathematical model.

According to the invention, the computer associated with the mathematical model determines before each pass x, a foreseeable value of the flow stress of the metal corresponding to the deformation to realise in the pass x considered, while taking into account the evolution, during the rolling operation, of the microcrystalline structure of the metal making up the product to be rolled, and the rolling load Fx to be applied in order to achieve the requested reduction in thickness, is calculated before each pass x according to the value thus predicted for the flow stress and the evolution of the said stress during the rolling operation.

Particularly advantageously, the rolling load Fx to be applied for a rolling pass is calculated while taking into account the predictable variation, along the nip, of the flow stress of the metal during the said pass x.

To this end, the rolling nip is divided into a series of p adjacent elementary portions $M_1, M_2, \ldots M_i, \ldots M_p$, each corresponding to an elementary length of forward travel of the product between the rolls, with an elementary deformation $\epsilon i$ of the product in each portion $M_1$ between an inlet section of thickness $e_{i-1}$ and an outlet section of thickness $e_i$, whereas, on the basis of data provided by the mathematical model, the computer determines, for each portion $M_i$, a predictable value $\sigma I$ of the flow stress of the metal, corresponding to the said elementary deformation $\epsilon i$ and deduces therefrom the elementary rolling load $dF_i$ to be applied to the considered portion $M_i$ in order to provide the said elementary deformation $\epsilon i$ and that, by integrating the elementary loads dFi into the successive portions $M_1, M_2, \ldots M_i, \ldots M_p$, the computer determines the global rolling load to be applied in order to achieve the requested reduction in thickness and controls, in relation to the global load thus calculated, the adjustment of the clamping means for maintaining the distance between the rolls, in order to achieve the requested reduction in thickness $(e_{x-1}-e_x)$, while taking into account the yield conditions of the metal along the nip and the yield effect resulting from the said global load.

It should be noted, however, that the invention enables thus to determine the rolling load Fx to be applied during a pass x while taking into account the predictable value of the flow stress of the metal resulting from the evolution of the microcrystalline state of the metal during the previous passes.

Generally, the rolling operation is performed according to a rolling scheme enabling to achieve in n successive passes a global reduction in thickness $(e_{x-1}-e_x)$.

According to another characteristic of the invention, the computer determines, by iteration, the rolling scheme to be adhered to while computing beforehand, for each pass, x, the maximum reduction in thickness leading to a predictable rolling load Fx compatible with the capacity of the mill, in relation to a number of rolling parameters comprising the thickness and the temperature of the product as well as its forward speed before entering the said pass x, in order to take into consideration the predictable evolution of the microstructure of the metal from one pass to the next.

In particular, the computer can be associated with permanent measuring means, during the pass, of the effective values of a set of rolling parameters comprising the rolling load applied at each moment, the forward speed of the product and the temperature of the said product respectively at the inlet and the outlet of the mill. Thus, at each pass x, the computer can compare these effective measured values with the values of the said parameters taken into account initially for the said pass x in the determination of the rolling scheme, in order to review the calculation of the said scheme and to add, if needed, correction factors to the parameters taken into account, in order to adapt the rolling scheme in the following passes.

According to a preferred embodiment of the invention, in order to take into account the microcrystalline evolution of the metal during the rolling operation, at least one modelling equation valid for a family of metals having an analogue microcrystalline behavior is established, on the basis of hot deformation tests carried out on sample pieces of at least one typical metal of this family, whereas the said equations depend on a set of parameters associated with the composition of the typical metal. The initial equations thus established are grafted to the mathematical model and, for rolling a product consisting of a metal of the same family as the typical metal, the model is calibrated for the metal to be rolled while modifying the parameters of the said theoretical equations in relation to results of deformation tests performed on a metal whose composition is at least similar to that of the metal to be rolled.

Particularly advantageously, to define modelling equations, an intermediate value can be determined, associated with the deformation speed of the metal and varying in a more or less linear fashion in relation to the flow stress in at least one deformation domain and, on the basis of deformation tests realised for a series of deformation temperatures and speeds held constant, a work-hardening diagram is established for which the variations of the said intermediate value can be represented approximately, in the said domain of deformation, by a family of straight lines to which corresponds at least one linear differential equation, associating the deformation with the flow stress and liable to be integrated by the computer.

On the basis of such a work-hardening diagram, we can establish at least two differential equations associating the deformation with the flow stress, respectively a first equation, linear in shape, giving by analytical integration, an expression of deformation in relation to the flow stress and a second equation liable to be integrated digitally in order to determine the predictable flow stress corresponding to a deformation to achieve.

According to another embodiment, whereas the modelling equations have been established initially for a typical metal and grafted to the mathematical model, these equations can be calibrated for the metal to be rolled, while performing first of all at least one rolling pass, at least one product made up of the metal to be rolled, in at least one roll stand adjusted conventionally and in measuring, during each pass, on the one hand the rolling load actually exerted and, on the other hand, the rolling parameters used by the computer in order to determine, using initial modelling equations, the rolling load to be exerted theoretically. Using a digital regression method, the modifications to be made to the parameters of the said initial equations can be defined in order to provide modelling equations specific to the metal to be rolled.

The invention also covers a particularly advantageous method to exploit the test results in order to establish the modelling equations. In such a method, on the basis of deformation test results each carried out at constant temperature and at constant deformation speed:

a first work-hardening diagram is established, comprising a series of representative curves, for each temperature T, of the variation of the temper-rolling rate $\theta=d\sigma/d\epsilon$ in relation to the flow stress $\sigma$, the digital data relating to each curve is transformed to establish a second normalised work-hardening diagram comprising a series of curves representative of the variation, in relation to the normalised running stress $\sigma^*=\sigma/\mu(T)$, whereas $\mu(T)$ is the shear modulus at the temperature considered, whereas the said curves have each at least a portion more or less rectilinear situated in at least one domain II, III of the diagram, and the said rectilinear portions are more or less parallel in each domain, each more or less rectilinear portion is modelled according to a first equation of the type:

$$k\sigma^*+k'=2\theta^*\sigma^*=b^2d\rho/d\epsilon$$

while using as an intermediate variable, the dislocation density $\rho$ such that $$\sigma=\mu b\sqrt{\rho}$$

and an analytical integration of the first equation is performed in order to establish, at least for each of the domains II, III, a second modelling equation $$\epsilon=-2/kb^2[X_s ln(1-x/x_s)+X]+\lambda$$

by defining $x=b\sqrt{\rho}=\sigma/\mu=\sigma^*$ and $x_s=-k'/k$, whereas $\lambda$ is an integration constant, whereby the parameters k and k' are determined, for each of the domains II, III, on the basis of the rectilinear portion of a curve of the second work-hardening diagram corresponding more or less to the predictable temperature of the metal and to the predictable deformation speed when entering the roll stand.

In each of the domains II, III of the work-hardening diagram, the coefficients k and k' of the first modelling equation can be determined by the computer while following a digital regression method, on the basis of the temperature and of the parameters representative of the crystalline state of the metal when entering the roll stand.

In order to take into account the evolution of the flow stress along the rolling nip, the former is divided into a series of successive portions M1, M2, . . . , Mi, . . . Mp, each corresponding to an elementary deformation $\epsilon i$, and the computer determines before each pass, in relation to the roll parameters measured at the inlet of the stand, the predictable flow stress $\sigma i$ in each of the said portions Mi by digital integration reverse of the second modelling equation in relation to the elementary deformation $\epsilon i$ to realise in the considered portion Mi and deduces therefrom the elementary rolling load dFi to be applied in the said portion Mi, whereas the global rolling load is calculated by integration of the said elementary loads along the nip.

The invention also covers numerous other advantageous characteristics that are subject to the sub-claims.

It should be noted that, owing to the fact that it enables to calculate accurately, and at any moment during the rolling operation, the predictable value of the flow stress, the process according to the invention could be integrated to several levels in the rolling process.

In particular, as the rolling parameters are measured during each roll pass, the computer may check whether the global rolling load calculated in relation to the reduction in thickness predicted by the rolling scheme is compatible with the capacities of the unit and whether the said predicted reduction in thickness makes optimum use of the said capacities and it can also check the said capacities and modify, if needed, the rolling scheme for the following passes.

But the invention will be understood better using the following description of a peculiar embodiment, given for exemplification purposes and illustrated by the appended drawings.

DETAILED DESCRIPTION OF THE INVENTION

Figure 1:
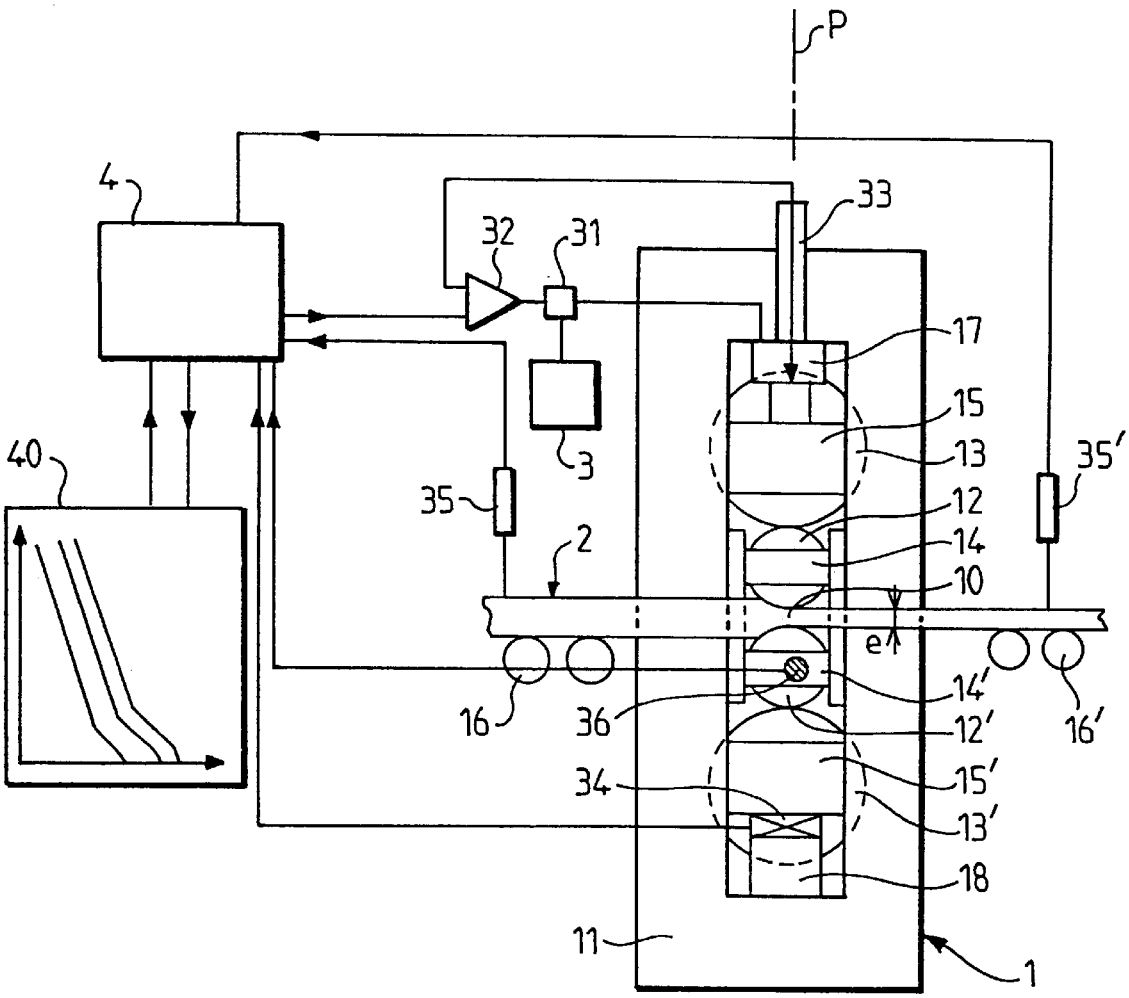
FIG. 1 represents schematically a roll stand associated with clamping control means according to the invention.

FIG. 1 shows schematically a roll stand 1 constituted, as usual, of two separate standards 11 connected by non-represented cross-beams and between which are placed several superimposed rolls. In the example represented, the roll stand is of quarto type and comprises thus two working rolls 12, 12' delineating a passage gap 10 for the product 2 to be rolled and resting, on the opposite side to the product, respectively on two back-up rolls 13, 13' of larger diameter. Each roll is mounted to rotate, at its ends, on two journals carried by bearings mounted in chocks, respectively working chocks 14,14' and back-up chocks 15,15'. The former are inserted into windows provided on both standards 11 of the roll stand and fitted, on their sides, with guiding faces along which slide the chocks of the rolls, parallel to a clamping plane P in which are placed more or less the axes of the rolls.

The roll stand 1 is also associated with product forwarding means, for instance two roller tables 16, 16' placed on either side of the stand in the case of a reversible mill. The rollers of the table 16 placed upstream are brought into rotation in order to control the forward travel of the product 2 which engages between the working rolls 12 and 12' and is driven by friction into the gap 10. After its thickness has been reduced, the product 2 is received by the roller table 16' located downstream.

Obviously, the difference between the width of the gap and the initial thickness of the product must be limited to prevent any failed engagement taking into account the diameter of the rolls 12, 12' and the thrust load exerted by the roller table 16.

Rolling the product 2 tends to move apart the working rolls that rest on the back-up rolls 13, 13'. To keep their distance, the roll stand is therefore fitted with clamping means, for example hydraulic or mechanical jacks 17, mounted on each standard 11 and resting on the chocks 15 of the upper back-up roll 13, whereas the lower back-up chocks 15' can simply be supported by wedges 18.

Preferably, the clamping means are hydraulic jacks 17 supplied conventionally by a circuit globally referred to by the reference 3, associated with a servo-valve 31 controlled by a regulator 32. The regulator 32 is associated with position transducers 33 and with pressure transducers 34. Thus, the clamping means 17 can be controlled in position and in pressure, in order to determine on the one hand the distance e of the back-up generatrices of the working rolls 12, 12' delineating the thickness of the gap 10 and, on the other hand, the maintenance of the distance selected for rolling, by application, between the rolls, of a clamping load called rolling strength, which can be measured by the transducer 34.

In a well-known fashion, separate jacks can also adjust the distance between the rolls, whereas the clamping jacks 17 are then used, essentially, for applying the rolling load in order to maintain the distance.

Besides, the roll stand 1 is also fitted with other transducers enabling to measure various rolling parameters, for example pyrometers 35, 35' for measuring the temperature of the product 2, respectively before entering the roll stand and when leaving the said stand, as well as means 36 for controlling the rotation speed of one of the working rolls, enabling to determine the forward speed of the product into the nip between the rolls.

The signals transmitted by all the transducers and corresponding to the measurements made are displayed at the inputs of a measuring central system 4 which comprises a computing unit capable of preparing a control signal for the regulator 32 for operating the clamping means in order to adjust and to maintain the requested distance between the working rolls 12, 12'.

According to the invention, the computing unit 4 comprises a computer 40 associated with a mathematical model, programmed in such a way as to calculate very accurately the rolling load to be applied, on the basis of modelling equations significant of the metal behavior and, especially, of its flow conditions in the nip between the rolls.

Figure 2:
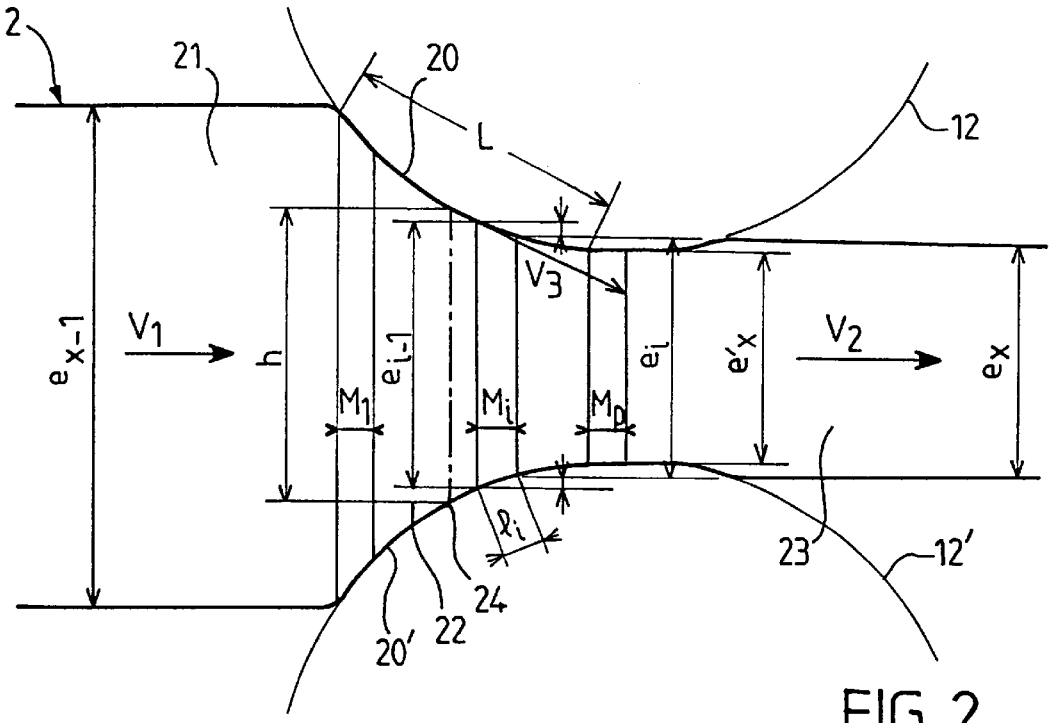
FIG. 2 illustrates schematically the rolling process of the product between two working rolls.

FIG. 2 illustrates schematically the process of thickness reduction of the metal product 2 between both rolls 12, 12'. Generally, the product 2 comprises an upstream portion 21, of thickness $e_{x-1}$, a central portion 22 corresponding to the running nip between the rolls which is delineated by two arcs of contact 20, 20', and a downstream portion 23 with a thickness $e_x$ which, in practice, is slightly greater than the distance $e'_x$ of the working rolls 12, 12'.

The roller table 16 whose rolls are brought into rotation, determines the forward motion of the product at an engagement speed VI into the mill. The front end of the product 2 comes then into contact with both rolls 12, 12'. The friction between the wall of the rolls and the product determines the engagement of the said product in the nip between the rolls, with reduction in thickness and metal flow. The consequence is a slight widening of the product but, essentially, an elongation of the said product, whereas the same quantity of metal is kept. As a result, the downstream portion 23 of the product is fed forward at a speed V2 greater than V1. Both rolls 12, 12' are brought into rotation at certain angular speed and, conventionally, a neutral point 24 of the product is distinguished for which the tangential forward speed V3 is equal to the peripheral speed of the rolls 12, 12" Along both arcs of contact 20, 20' between the product and the rolls, the tangential forward speed of the product therefore increases gradually from V1 to V2. It is smaller than V3 upstream of the neutral section 24 and greater than V3 downstream.

The value of the frictions at the interface between the product and the rolls varies therefore throughout the arc of contact 20, whereas the relative speed itself is variable and disappearing at the neutral section 24.

We know that the Sims relation can calculate the rolling load per width unit:

$$F=Qf.K.L \tag{1}$$

In which Qf is a friction factor, L the length of the arc of contact 20 and K a factor representative of the average value of the flow stress σ of the metal during deformation.

The friction factor Qf, depending on the ratio of the length L of the arc of contact 20 to the average thickness h of the product, can be assessed with relatively good accuracy.

We have therefore $Qf=f(L/h)$ (2)

These values can be measured in a known fashion on the basis of the radius of the working rolls, the thickness of the product at the inlet of the stand and the distance between the rolls at the outlet of the nip.

As indicated previously, further to a certain degree of elasticity of the metal, the outlet thickness $e_x$ is slightly greater than the actual thickness $e'_x$ of the gap between the rolls, whereas the difference can be determined in a known fashion.

The factor K depends on the temperature, the composition of the product and its structure, but we have noted that complex phenomena such as the evolution of the metal microstructure during deformation had to be involved.

As stated above, even in sophisticated units, the previous systems have contented themselves with storing global parameters, determining the deformation conditions of the product in relation to the grade of the steel, in order to establish a table of reference of the rolling conditions for a known steel. That way, the same parameters could be used when the same steels were on the production book of the rolling unit. However, to do so, it was necessary to assess the average value of the flow stress σ in order to deduce the factor K, so as to calculate the rolling load while applying the Sims relation.

Besides, in the case of steels that have not been rolled previously, it could only be a trial and error process.

On the contrary, the object of the invention is a new process in which the global rolling load to be applied can be determined more accurately while providing the means to take into account the evolution of the crystalline microstructure of the metal during the rolling operation in order to assess the value of the flow stress σ of the metal at a given moment of the rolling operation.

To this end, the applicant has conducted far-reaching metallurgical studies with a large number of laboratory experiments which have led to a new representation of the parameters significant of the true microstructural evolution of the steel, enabling to model this evolution according to the global rolling objectives (reduction in thickness, evenness, temperature), whereas this representation leads to programmed modelling equations in the mathematical model and liable of being integrated by the computer 40 associated with the control central unit 4 of the mill actuators.

Thus, a process for adjusting clamping means could be set up, integrating the modelling thus developed in order to apply the rolling load between the rolls which is exactly necessary.

Moreover, such a process also enables to suit the rolling scheme to the conditions observed at each pass and, thus, to follow an optimum rolling scheme.

The process according to the invention enables to take into account the evolution of the running conditions of the metal, on the one hand during the successive passes and, on the other hand, along the nip, during the same pass.

To this end, the roll nip is divided into a series of p adjacent elementary portions $M_1, M_2, \ldots M_i, \ldots M_p$. As stated schematically on FIG. 2, each elementary portion Mi corresponds to an elementary length of forward travel $l_i$ of the product between the rolls, with an elementary deformation $\epsilon_i$, which is defined in a known fashion, on the basis of the reduction in thickness $[(e_{i-1})-e_i]$ to be realised in the portion considered, whereas $e_{i-1}$ is the thickness of the inlet section of the portion and ei the thickness of the outlet section.

According to the temperature T of the metal, the deformation ϵ corresponding to the reduction in thickness requested at the level considered of the nip and the deformation speed $\dot{\epsilon}=d\epsilon/dt$, diverse metallurgical phenomena may crop up during the forward travel of the product into the nip.

These phenomena, which have been described in diverse recent studies, can be summed as follows:

First of all, work-hardened metal can be noted, which can be ascribed to an increase in its dislocation density ρ. This value, which can be measured on a metal sample using an electronic transmission microscope, represents the cumulated length, by volume unit of the metal, of linear crystalline defects, called dislocations.

We know that the dislocation density, which is currently assessed in metres per cubic metre, is linked with the flow stress σ by the Taylor relation:

$$\sigma=\mu b\sqrt{\rho} \quad (3)$$

in which b is a constant and $\mu$ is the shear modulus of the metal. We know that this modulus depends of the Temperature T of the metal and is given by the formula $$\mu_{(T)}=E_{(T)}/2(1+\nu) \quad (4),$$

in which $E_{(T)}$ is the modulus of elasticity, so-called Young modulus and ν is the Poisson coefficient.

Then we note that, very quickly, whereas work-hardening is resumed, there is also a so-called recovery phenomenon, which tends to diminish the dislocation density ρ by mutual annihilation of neighbouring dislocations.

Moreover, for most steels, there may be, beyond a certain deformation, a so-called dynamic recovery phenomenon, which tends to diminish the dislocation density ρ.

It has therefore been suggested that, while taking into account these phenomena, the behavior of the metal could be analysed during a deformation in order to deduce quite an accurate assessment of the predictable value of the flow stress, which is the first factor upon which the rolling load depends and which evolves constantly from one pass to the next and even during a pass, along the running nip of the product between the rolls.

It is precisely this evolution which had not been taken into account until now, whereas the rolling load is calculated on the basis of an average value of the flow stress appraised globally for the nip assembly.

The invention enables, on the contrary, to take into consideration the variation of the flow stress linked to the evolution of the microstructure during the rolling operation and therefore provides the means to assess, much more accurately as before, the rolling load to be applied in order to achieve and to maintain the requested reduction in thickness at each pass.

To this end, the behavior of the steel has been studied in depth while plotting experimental curves on the basis of which modelling equations liable to be grafted to a mathematical model associated with a control computer of the mill, could be established, so that the said computer could calculate the rolling load to be applied to each pass in relation to a set of assessed or measured parameters.

Figure 3:
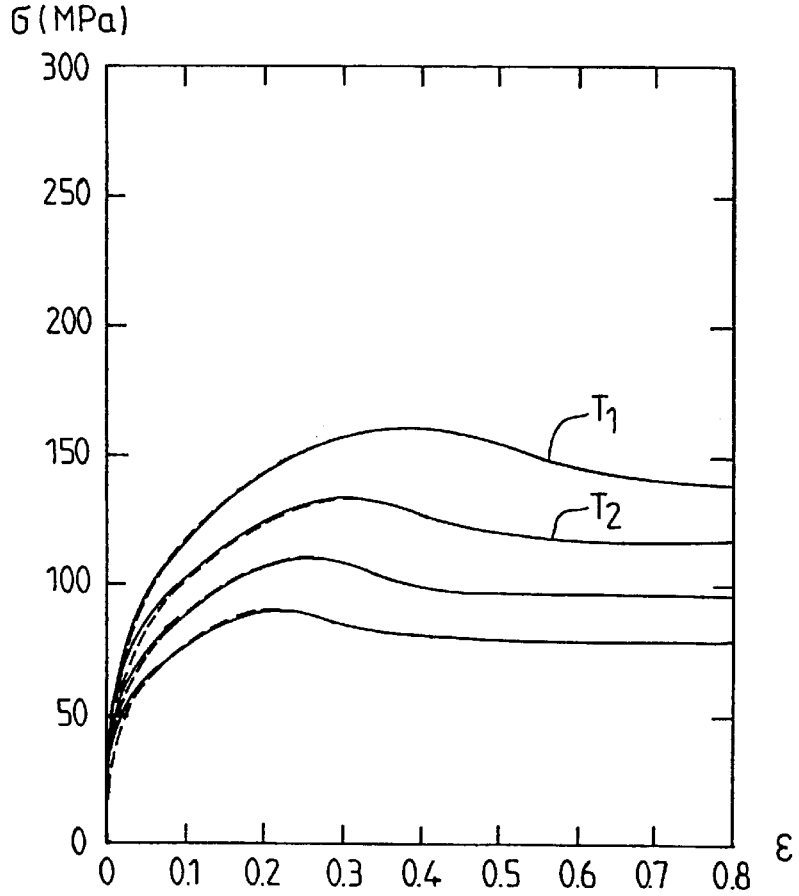
FIG. 3 is a diagram indicating the evolution of the flow stress of the rolled metal in relation to the deformation in the nip.
Figure 6:
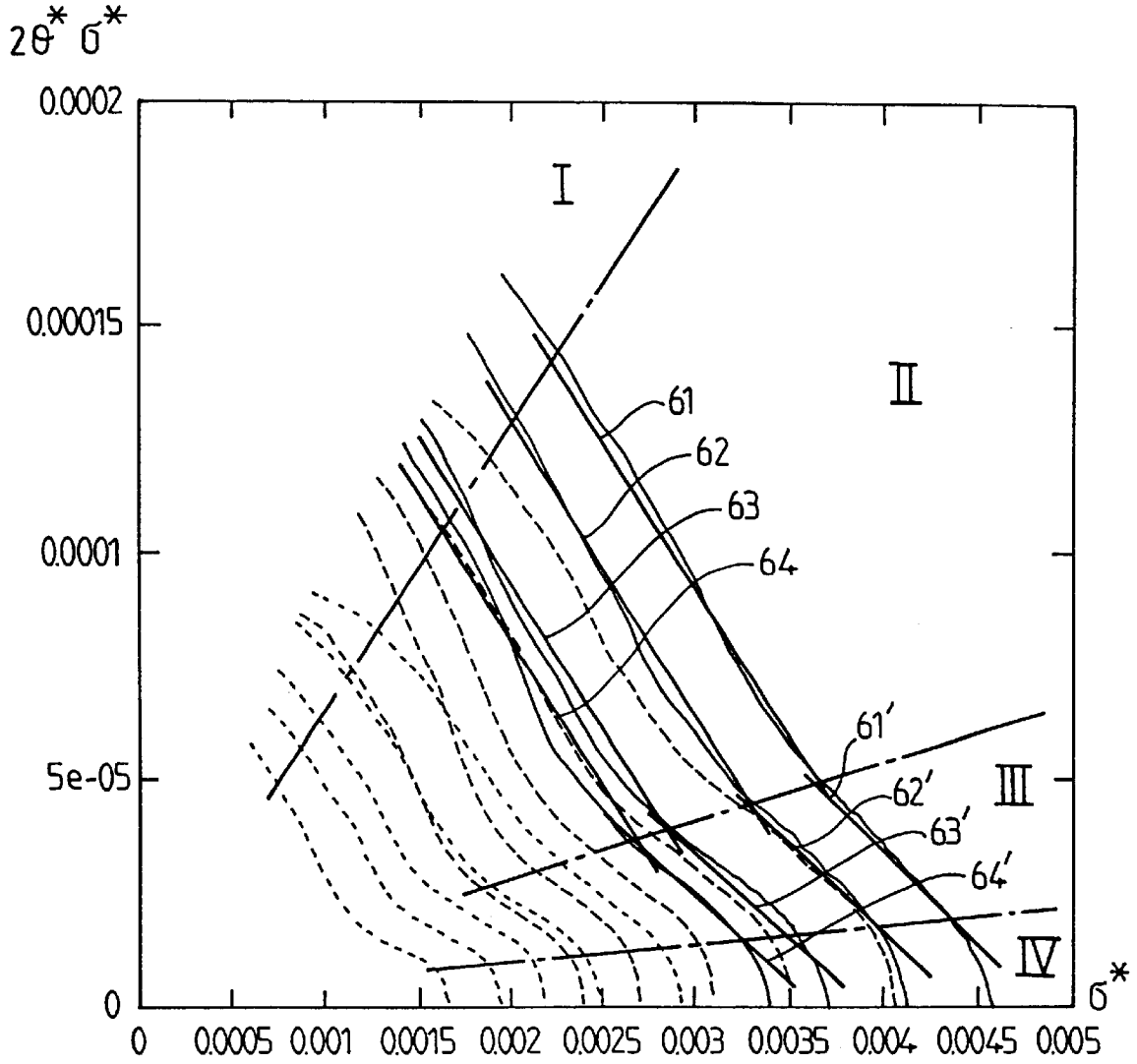
FIG. 6 illustrates the use of the work-hardening diagram for setting modelling equations.

The steps of the process according to the invention are illustrated on FIGS. 3 and 6.

The evolution of the flow stress σ is manifest on the diagram of FIG. 3 which indicates, for different temperatures T1, T2, . . . , the variations of the current value in the nip of the flow stress $\sigma$, indicated in ordinate, in relation to the cumulated deformation $\epsilon$ indicted in abscissa while assuming, what is close to reality, that the deformation $\epsilon$ and the temperature T vary at speeds $\dot{\epsilon}=d\epsilon/dt$ and $\dot{T}=dT/dt$ more or less constant along the chock.

The curves of FIG. 3 have been established on the basis of laboratory experiments, for example homogeneous compression hot tests carried out at temperatures T1, T2 . . . on samples of the same metal.

We have observed that, to report the behavior of the metal, it was interesting to use as an intermediate variable the work-hardening rate $\theta=d\sigma/d\epsilon$ which, for a given deformation and temperature, corresponds to the slope of one of the curves of FIG. 3.

To interpret the physical phenomena handling the deformation of the metal, we shall therefore plot a first diagram of work-hardening representing the evolution of the work-hardening rate $\theta$ in relation to the flow stress $\sigma$.

However, we prefer to use the normalized values $$\theta^*=\theta/\mu_{(T)} \text{ and } \sigma^*=\sigma/\mu_{(T)} \tag{5}$$

whereas $\mu_{(T)}$ is the shear modulus as defined above.

Figure 4:
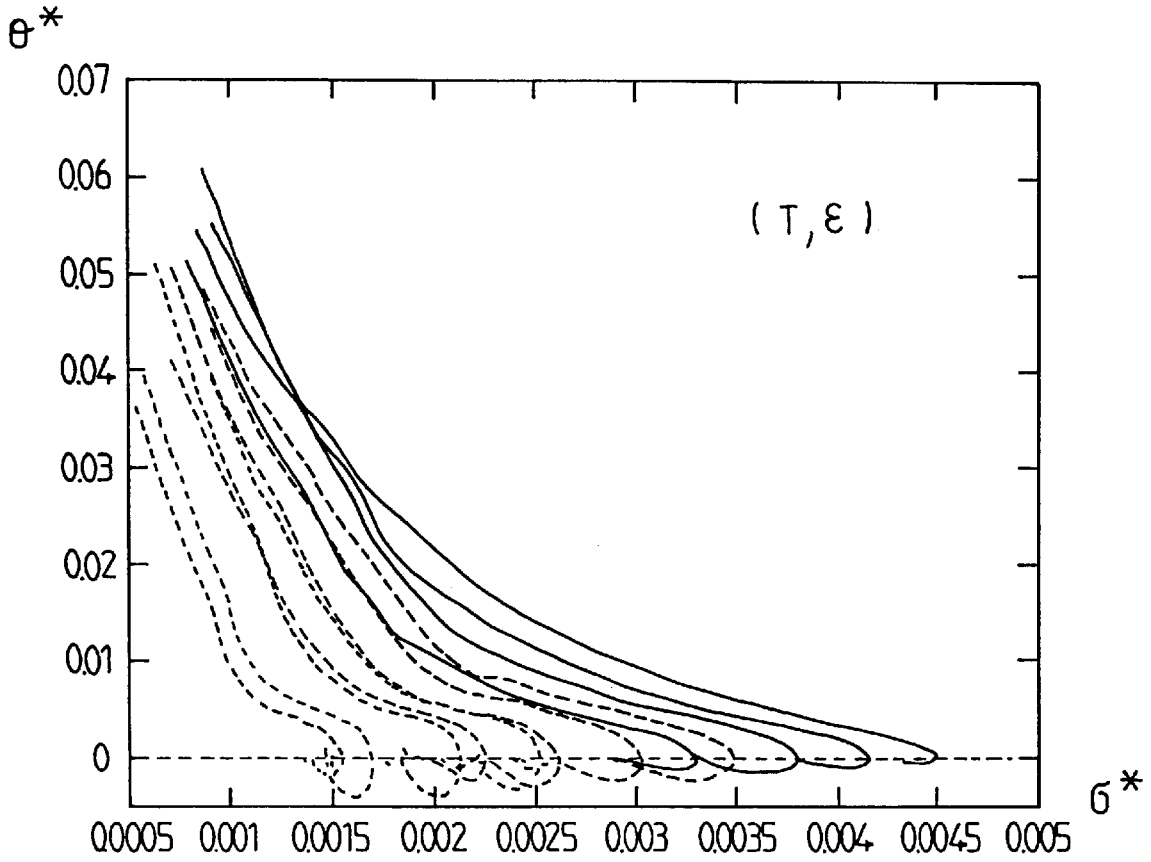
FIG. 4 is a diagram representing the evolution of the work-hardening ratio of the metal in the nip in relation to the flow stress.

FIG. 4 gives an example of this first diagram of work-hardening, each curve representing the variation of the standardised work-hardening rate $\theta^*$ in relation to the normalized flow stress $\sigma^*$, for a constant temperature T and a constant deformation speed $\dot{\epsilon}$.

We note that the form of the curves thus obtained evolves when the deformation speed and the temperature vary.

To implement the invention, it has been suggested to transform the digital data having enabled to plot the curves of FIG. 4, by changing a variable in order to lead to curves that can be used for a simple modelling in a computer.

It has appeared particularly advantageous to use as an intermediate variable the product $2\theta^*.\sigma^*$ of double the normalized work-hardening rate times the normalized flow stress.

Figure 5:
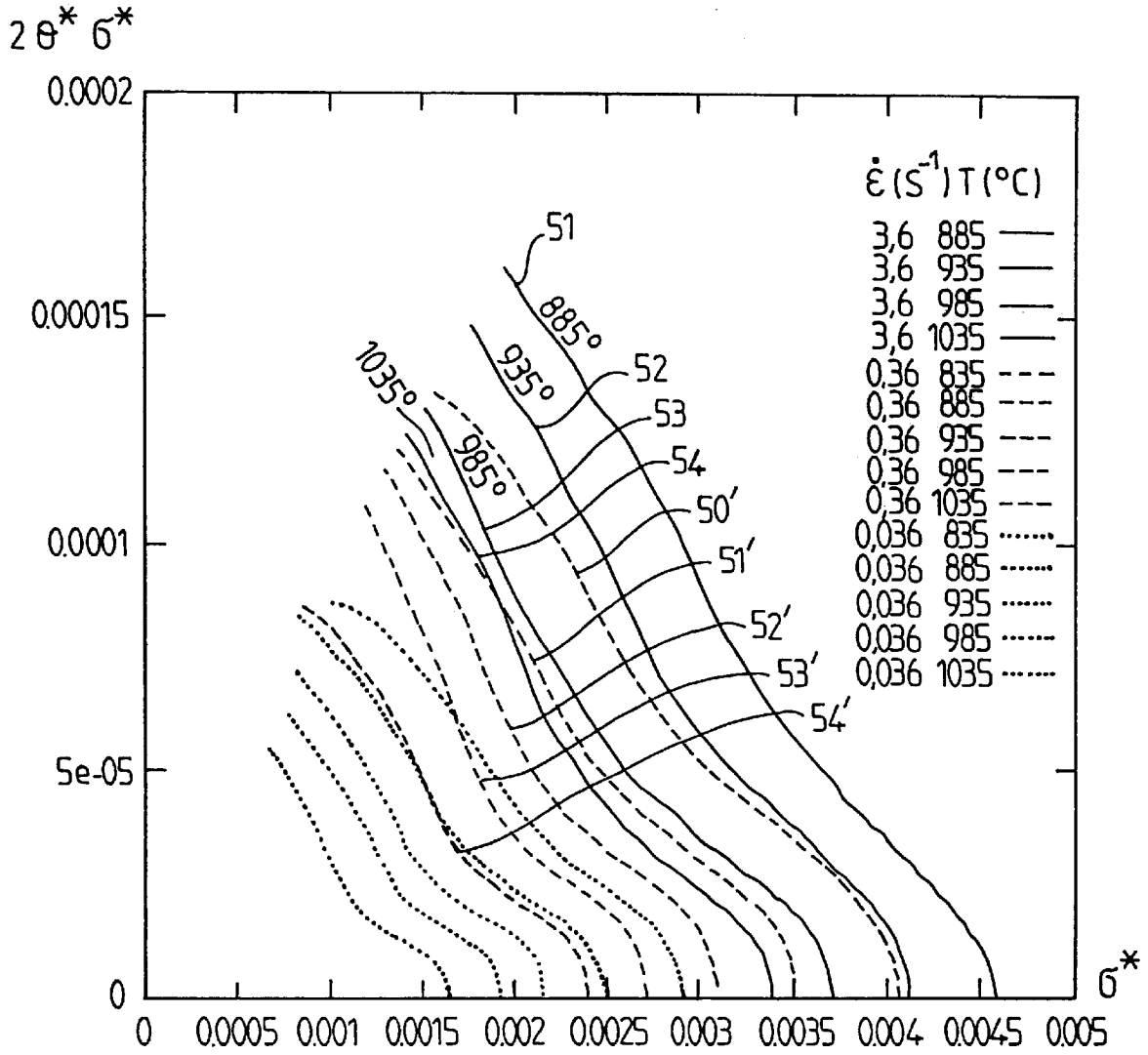
FIG. 5 is a work-hardening diagram illustrating a new representation of the evolution of the flow conditions in the nip.

We then obtain a second diagram of work-hardening, represented on FIG. 5, which indicates the variation of the value $2\theta^*.\sigma^*$, indicated in ordinate, in relation to the standardised flow stress $\sigma^*$ indicated in abscissa.

As previously, we consider a constant temperature and a constant deformation speed, whereas the transformation is performed for each curve.

On the second diagram of work-hardening of FIG. 5, the deformation speed $\dot{\epsilon}$ and the temperature T to which correspond the curves of the diagram are indicated at the top of the diagram at the right side for exemplification purposes. Different groups of experimental curves are thus distinguished. For example, we have plotted on the diagram four curves 51, 52, 53, 54 in a different way, corresponding respectively to temperatures of 885° C., 935° C., 985° C., 1035° C., for the same deformation speed $\dot{\epsilon}=3.6\ s^{-1}$ and five curves 50', 51', 52', 53', 54', corresponding respectively to temperatures of 835° C., 885° C., 935° C., 985° C., 1035° C., for a deformation speed $\dot{\epsilon}=0.36\ s^{-1}$ ten times less important.

We note that, particularly advantageously, in this new domain of representation ($2\theta^*.\sigma^*$, $\sigma^*$), each curve comprises at least two practically rectilinear portions, whereas these rectilinear portions are, in each domain, more or less parallel to one another.

As shown on FIG. 6, the second diagram 'work-hardening/deformation', illustrates two domains II and III that cover the largest portion of the useful domain of the deformation and in which the value $2\theta^*.\sigma^*$ varies in a more or less linear fashion in relation to the normalized flow stress $\sigma^*$. The non-linear domain IV corresponds to the appearance and to the development of dynamic recrystallisation.

Obviously, to each type of steel corresponds a specific diagram and, in each diagram, each curve and, consequently, each straight line corresponds to a set temperature and to a set deformation speed, but interpolations are possible.

In order to model these curves, it is advantageous to consider as an intermediate variable the dislocation density $\rho$ defined above.

Indeed, the differentiation of the so-called Taylor equation (3) gives:

$$d\sigma/d\rho=\mu.b/2\sqrt{\rho} \tag{6}$$

from which the following can be deduced:

$$\theta^*=d\sigma/\mu d\epsilon=b/2\sqrt{\rho}\,d\rho/d\epsilon \tag{7}$$

As $$\sigma^*=\sigma/\mu=b\sqrt{\rho}$$

then we have $$2\theta^*\sigma^*=b^2 d\rho/d\epsilon \tag{8}$$

Since in each of both domains II and III of FIG. 6, the value $2\theta^*\sigma^*$ varies in a more or less linear fashion in relation to $\sigma^*$, the straight lines of FIG. 6 can be replaced approximately with the curves of FIG. 5.

These curves being more or less parallel, we may describe the equation of the straight lines in the following linear form:

$$2\theta^*\sigma^*=b^2 d\rho/d\epsilon=k\sigma^*+k' \tag{9}$$

which constitutes a first modelling equation of the behavior of the metal, in which the constants k and k' can be deduced from the diagram of FIG. 6, whereas k is the slope of the straight line representative of the curve considered and k' a constant.

Both families of straight lines corresponding to the steel considered, which have different slopes, respectively $k_{II}$ and $k_{III}$ for each of both domains II and III where the behavior is linear, are therefore represented by equations which can be programmed in the mathematical model associated with the computer 40. The latter can then, using known mathematical methods, realise analytical integration of the equation (9) which leads, for each domain II, III to an expression of the deformation $\epsilon$ of the form:

$$\epsilon=-2/kb^2[x_s ln(1-x/x_s)+x]+\lambda \tag{10},$$

with:

$$x=b\sqrt{\rho}=\sigma/\mu=\sigma^*$$

and $$x_s=-k'/k,$$

$\lambda$ is an integration constant.

The initial value of the flow stress in the domain II and the continuity at the junction points between two corresponding straight lines in the domains II and III enables to determine the values of the integration constants $\lambda_{II}$ and $\lambda_{III}$ corresponding respectively to the domains II and III.

It should be noted that, for simplification purposes, the law of evolution is caused to depend on a minimum set of four parameters $k_{II}$, $k_{III}$, $X_{s2}$, $X_{s3}$ (11).

However, these parameters could be more numerous in order to take the relations between themselves into account.

Each work-hardening diagram, established on the basis of test results, corresponds to a steel of determined composition.

For exemplification purposes, the diagrams of FIGS. 3 to 6 have been prepared experimentally for a steel of the following composition, in percentages in weight:

C: 0.08; Mn: 1.1; Si: 0.25; Fe: the remainder.

It can be seen, on FIG. 6, that for example in the domain II, for each deformation speed $\dot{\epsilon}$, the equations of a family of parallel straight lines 61, 62, 63, 34 corresponding to diverse deformation temperatures 885° C., 935° C., 985° C. and 1035° C. can be prepared.

The same goes in the domain III and for other deformation speeds.

In the following expose of the process, we assume that, knowing the composition of the steel to be rolled, we have succeeded, on the basis of prior tests, in determining the modelling equations corresponding to the behavior of this steel for certain deformation speeds and at diverse temperatures. These modelling equations are therefore grafted to the mathematical model associated with the computer 40 that will be thus able, for a product made up of the same metal, to define the modelling equation applicable to a given moment of the rolling operation, taking into account the deformation speed and the temperature of the product at that moment.

The parameters (11) on which the law of evolution depends can be identified on the basis of tests, for example homogeneous compression hot tests carried out in a laboratory, each at a constant speed of deformation and at a constant temperature, in order to determine the experimental stress/deformation curves significant of the behavior of the steel in these conditions.

As indicated above, the parameters $k_{II}$, $k_{III}$, which are the slopes of the straight lines serving for modelling the law of work-hardening, respectively in the domains II and III depend only on the composition of the steel and of its grain size, i.e. the crystalline state which the metal reached after the different and successive rolling passes.

The parameters $x_{s2}$, $x_{s3}$ depend, furthermore, on the deformation speed $\dot{\epsilon}$ and on the temperature T.

After determination of the parameters (12), the equations (10) and (11) representative of the metal to be rolled, and grafted to the mathematical model will enable the computer 40 to adjust the clamping means by proceeding as follows:

As indicated, the mill is fitted with transducers that enable, during each roll pass, to measure the following values in real time:

- the rolling load applied between the rolls which is provided by a pressure measurement in the clamping jacks 17 or by a load measuring cell associated with the wedges 34;
- the exact gap of the working rolls provided by the position measuring cell 33 associated with the clamping devices;
- the temperature of the product at the inlet and at the outlet of the mill, provided by the transducers 35, 35';
- the actual rolling speed provided by a measurement transducer 36 mounted on the driving shaft of the roll stand and indicating the angular speed of the working rolls.

Moreover, the deformation speed of the metal can be determined in each point of the nip, in relation to the reduction in thickness to be achieved and to the rolling speed.

In practice, as indicated on FIG. 2, the computer 40 will divide the running nip 20 into a series of portions $M_1$, $M_2 \ldots, M_i \ldots, M_p$. For each portion Mi, it determines the reduction in thickness to achieve $\epsilon=[(e_{i-1})-e_i]$ and the rolling speed at the place of the nip considered, and may deduce the deformation speed $\dot{\epsilon}_i$ therefrom.

Using the product temperature at the inlet of the roll stand and the deformation conditions, the mathematical model may assess the temperature of the product and the deformation speed in the portion Mi considered in order to deduce the straight line of the diagram of FIG. 6 and the modelling equations (9, 10) applicable within this portion, while making the necessary interpolations to take into account the temperature and the deformation speed when the said values do not match those of the tests.

With a digital integration reverse of the second modelling equation (10), for example, by using the method of finite differences, the computer can determine, for each portion Mi, the predictable value a of the flow stress corresponding to the elementary deformation $\epsilon_i$ to be achieved, and thus deduce therefrom the estimated value of the elementary rolling load dFi to be applied in the said portion Mi.

Thus knowing the elementary rolling load in each of the nip portions, the computer can, by integration, determine the global rolling load Fx to be applied over the whole nip by the clamping means 27 during the pass x.

Besides, all the physical and mechanical characteristics of the different members of the roll stand as well as the conditions of elastic deformation of the said roll stand have been programmed into the computer. The latter can therefore, on the basis of the global rolling load Fx thus calculated, determine the predictable yielding effect during this pass and control the adjustment of the clamping means 17 in order to compensate for this yielding.

Similarly, the computer takes into account the mechanical and physical characteristics of the product, in particular its elasticity, to determine the slight increase in thickness of the product, in a known fashion at the outlet of the mill.

Taking all these factors into account, the computer can then determine the gap $e'_x$ very accurately which should be adjusted and maintained between the working rolls 12, 12' in order to achieve the requested reduction in thickness $[(e_{x-1})-e_x]$ and control, during the pass considered, the adjustment of the clamping means, in order to apply between the rolls the rolling load that is effectively necessary to maintain this gap.

As indicated, the work-hardening diagrams enabling to prepare the modelling equations are based on test results.

As we know in advance the composition of the metal to be rolled, it is possible to proceed to the necessary tests on samples of this metal. The equations prepared for a metal may, besides, be stored for future use, for the production of a metal already rolled.

However, when rolling a new metal, it is not often possible to establish, as stated above, modelling equations whose parameters have values specific to the rolled metal.

In order not to proceed to tests every time a new metal will be rolled, methods have been developed which enable to use equations previously established and already available in the mathematical model.

These methods are based on the fact that, for the metals of a same type, the general outline of the curves of the work-hardening diagram, which illustrates the behavior of the metal during deformation, remains similar and that the equations of the straight lines corresponding to these curves and established for a metal can be adapted to another metal while simply correcting the parameters (12).

In practice, we shall therefore perform tests on a typical metal representative of a family of metals of analogue behavior, in order to establish a work-hardening diagram as that represented on FIGS. 5 and 6, in order to deduce the modelling equations (10) and (11) representative of this metal, which are grafted to the mathematical model.

Then, when we have to roll a metal of the same family but of different composition, it suffices to calibrate the model for this new metal and this operation should preferably be as quick as possible.

According to a first method according to the invention, tests are first of all conducted on a selection of steels representative of a domain of chemical composition for which we wish to calibrate the model with, for each one of them, values differing from the initial grain size, which determine the starting condition of the microstructure of the metal. Moreover, the tests are conducted for different temperature and deformation speed values in order to cover a stress domain matching the loads developed during the different roll passes and for which the model has been established.

On the basis of the results of the tests thus carried out on specimens, we establish the corresponding work-hardening diagrams that are analogue to those of FIGS. 4 and 5. The modelling equations specific to each of the steels can then be calibrated while determining, by known digital regression techniques, the set (12) of the four parameters of the work-hardening law applicable to the steel considered.

These digital regression mathematical methods are applied, in the domain studied, to empirical laws involving the chemical composition and the grain size as well as the temperature and the deformation speed for the parameters $X_{s2}$, $X_{s3}$.

The values calculated for these parameters, derived from the modelling of the domain III can be modified in order to take into account, in the domain IV of the appearance of the dynamic recrystallisation.

We have calibrated the model according to a model of composition covered by the different steels for which tests could be performed.

When the steel to be rolled exhibits a different composition while remaining in the domain for which the model is calibrated, it is possible, by using for instance the phenomenological model of Choquet, to determine the initial grain size and to deduce therefrom, by known methods, the corrections to be made to the coefficients of the work-hardening law in order to adapt the said law to the steel to be rolled.

It should be noted that the computer conducts these operations and that the model can therefore be calibrated very quickly when a new steel reaches production, as soon as it falls into the domain of composition covered by the tests performed previously.

When the steel to be rolled exhibits more or less the same composition as one of these steels, it suffices, at each pass, to determine the straight line of the model matching the rolling conditions.

Still, we shall see below how these tests can be replaced with manually adjusted rolling passes.

The equations (9) and (10) of the mathematical model being calibrated for the metal to be rolled, the computer will now be in a position to adjust the clamping means while proceeding as follows:

Such a method of calibration is valid in most cases since we generally know the production program in advance and we have been able to conduct the necessary tests.

However, the way the model takes the evolution of the structure of the metal into account also enables to implement a simpler calibration method, in particular to roll products made up of a steel outside the domain of chemical composition for which the model had been programmed.

With this other method, the tests on specimens are simply replaced with the first roll passes performed on the product to be rolled with a manual adjustment.

Indeed, as a rolling unit is always foreseen for a certain type of products, the mathematical model associated with the computer could be programmed, in the fashion indicated above, on the basis of tests conducted on a typical metal.

At the onset, the first roll passes are performed while adjusting the mill manually and the rolling parameters applied are measured and compared in real time.

With the digital regression methods reminded above and by using the Choquet method, we may determine the parameters of the equations applicable to the product thus rolled.

The equations programmed are thus calibrated for the new metal in relation to the behavior of the latter during rolling, on the basis of indications provided by the manually adjusted passes.

The process which has just been described thus enables to determine with great accuracy, before each rolling pass, the gap to be maintained and the rolling load to be applied by the clamping means, while taking into account, not only the nature of the product and its sizes, but also the condition of the metal further to the previous pass, as well as the predictable variation in the flow stress along the nip, during the pass. But the invention will also exhibit other advantages.

Indeed, the differential equations (10) and (11) established in the fashion described above, enable, by reason of their linear character, to link in both directions the deformation $\epsilon$ to the flow stress $\sigma$ since they can be integrated in one direction, analytically, to express the deformation in relation to the stress and, in the other direction, digitally, to link the stress to the deformation.

It results that the process subject of the invention can be integrated at several levels into the rolling process.

In particular, we have seen that the transducers mounted on the mill measure the actual rolling parameters and, especially, the load applied between the rolls, the exact gap, and the product temperature at the inlet and at the outlet and the rolling speed permanently.

On the basis of these indications and using equations programmed in the mathematical model, the computer can then recalculate the load to be applied between the rolls in the actual rolling conditions observed in order to compare the said load with the load measured during the same rolling pass. This comparison enables adaptation of the set (12) of the parameters of the evolution law defined by the modelling equations and recalculation with these recalibrated coefficients, of the adjustment of the mill for the following pass and so on and so forth, for each pass of the rolling scheme initially foreseen by the strategy.

If too great differences are noticed, the measurements taken then enable to modify the values selected during the laboratory tests in order to recalculate the whole strategy aiming at reducing the thickness of the product and to establish a new rolling scheme.

Consequently, for each reduction in thickness, the model can take into account measurements performed during the rolling operation in order to introduce correction factors to the values of the parameters of the evolution law which was predetermined by the laboratory data. Moreover, if significant differences are noted, the process according to the invention enables to review the calculation of the rolling scheme in order to modify it according to the reduction passes remaining, whereby this recalibration and verification operation takes place before each rolling pass until the final thickness is achieved.

The process according to the invention is thus applicable successively at the start-up of the rolling operation, then at each stage, while determining at the same time the accuracy of the geometrical tolerances of the product fabricated and the optimisation of the use of the industrial production tool.

Indeed, the process can be integrated to the calculation strategy of the rolling scheme using an iterative optimisation method taking into account the general data of the unit and of the product.

In such a method, before rolling, the computer 40 receives the general data relating to the product entering the mill, the chemical composition of the steel, the raw thickness of the product, the temperature at the inlet of the mill, the final target thickness, etc. Since the predictable flow stress and the rolling load to be applied in order to realise a given reduction in thickness can be calculated accurately, it is possible, at each pass, to make sure whether the reduction in thickness foreseen by the rolling scheme leads to an excessive rolling load, calling for a smaller reduction in thickness or, conversely, to realise a larger reduction in thickness leading to an acceptable rolling load.

Consequently, while taking into account the power available on the rolling stand(s), the possible loads and the final target thicknesses, the computer associated with the mathematical model can adapt the rolling scheme in order to use the capacities of the installation in optimum conditions, whereas the model can effectively take into account at each pass the condition of the product coming from the previous pass.

Obviously, the invention is not limited to the details of the embodiments that have just been described, whereas the process can be suited to the circumstances while remaining within the scope of protection defined by the claims. In particular, it is only for exemplification purposes that the figure shows a quarto mill, whereas the process is applicable in the same fashion to a duo, a sexto or any other type of hot mill. Similarly, the invention has been described for a roll stand, but is applicable in the same way to all the stands, whether reversible or not, of a hot rolling unit, whereby these stands can be isolated to constitute the shaper of a band line, hot units or even operate in tandem, for example to make up the finisher of the band line or still to form a set operating as a continuous tandem.

Moreover, for simplification purposes, we have established modelling equations depending on four parameters only, but they could obviously be more numerous.

Besides, the idea of the invention being to assess the flow stress of the metal while using the knowledge acquired on the behavior of the metals, such as the Taylor or Sims relations or the Choquet model, the evolution of this knowledge could evidently be exploited to improve or to modify the process while taking into account, from another standpoint, the evolution of the structure of the metal during a deformation.

Similarly, other calculation methods could be contemplated to solve digitally the differential equations of the evolution law. In particular, we could use, for the adjustment model, a method for direct calculation of the flow stress without taking as an intermediate variable the dislocation density. Other experimental methods, other than hot compression, but enabling to determine the stress in relation to the deformation could also be used.

The reference signs inserted after the technical characteristics mentioned in the claims solely aim at facilitating the understanding thereof and do not limit their extent in any way.

What is claimed is:

1. A process for rolling a metal product by successive passes in a unit comprising:

a holding roll stand with two separate roll standards;

at least two working rolls, superimposed between the standards of the roll stand;

means to control forward motion of the product during a rolling operation in a nip delineated by two arcs of contact of the product with both rolls, between an inlet section and an outlet section of the nip;

clamping means resting, respectively, on the rolls and on the roll stand, for adjusting a distance between the working rolls corresponding to a reduction in the thickness to be carried out and for maintaining the distance during a rolling pass, by applying, between the working rolls, a rolling load that depends on mechanical and physical characteristics of the roll stand and of the product and on flow conditions of the metal along the rolling nip, and determines a yielding effect of various members of the stand tending to increase the distance;

means, controlled by a calculation unit comprising a computer associated with a mathematical model, for adjusting the clamping means, wherein, before each pass, the calculation unit associated with the mathematical model determines a predictable variation value of flow stress of the metal corresponding to a deformation to be realized in the pass considered, while taking into account an evolution, during the rolling operation, of a microcrystalline state of the metal making up the product to be rolled, and wherein a rolling load (Fx) to be applied in order to achieve a requested reduction in thickness ($e_{x-1}-e_x$), is calculated before each pass according to the value thus predicted for the flow stress and the evolution of the microcrystalline during the rolling operation.

2. A rolling process according to claim 1, wherein the rolling load (Fx) to be applied for a particular rolling pass (x) is calculated while taking into account the predictable variation, along the nip, of the flow stress of the metal during said particular pass (x).

3. A rolling process according to claim 2, wherein in order to take into account the variation in the flow stress, the rolling nip is divided into a series (p) of adjacent elementary portions ($M_1$, $M_2$, . . . $M_i$, . . . $M_p$), each corresponding to an elementary length of forward travel of the product between the rolls, with an elementary deformation $\epsilon i$ of the product in each portion ($M_i$) between an inlet section of thickness ($e_{i-1}$) and an outlet section of thickness ($e_i$), wherein, based on of data provided by the mathematical model, the computer determines, for each portion ($M_i$), a predictable value ($\sigma_i$) of the flow stress of the metal, corresponding to the elementary deformation ($\epsilon i$) and deduces therefrom an elementary rolling load to be applied to the considered portion (Mi) in order to import the elementary deformation ($\epsilon i$) and, wherein, by integrating the elementary loads (dFi) into successive portions ($M_1$, $M_2$, . . . $M_i$, . . . $M_p$), the computer determines a global rolling load to be applied in order to achieve the requested reduction in thickness and controls, in relation to the global load thus calculated, the adjustment of the clamping means for maintaining the distance ($e'_x$) between the rolls, in order to achieve the requested reduction in thickness ($e_{x-1}-e_x$), while taking into account the flow conditions of the metal along the nip and the yielding effect resulting from the global load.

4. A process according to any of the claims 1, 2 or 3, wherein the rolling load (Fx) to be applied during a particular rolling pass (x) is determined while taking into account predictable value of the flow stress of the metal resulting from the evolution of the microcrystalline state of the metal during any previous passes.

5. A rolling process according to one of the claims 1 to 3, wherein the rolling operation is performed according to a rolling scheme enabling, in n successive passes, a global reduction in thickness ($e_o-e_n$), wherein each rolling pass performs a reduction in thickness ($e_{x-1}-e_x$), and wherein the computer determines, by iteration, the rolling scheme to be adhered to while computing beforehand, for each particular pass (x), a maximum reduction in thickness leading to a predictable rolling load Fx compatible with the capacity of the unit, in relation to of number of rolling parameters including a thickness and a temperature of the product as well as a forward speed of the product before entering the particular pass (x), in order to take into consideration a predictable evolution of the microstructure of the metal from one pass to the next and along the nip, throughout the particular pass (x) considered.

6. A rolling process according to claim 5, wherein the computer is associated with permanent measuring means, during the pass, of effective values of a set of rolling parameters including the rolling load applied at each moment, the forward speed of the product and the temperature of the product respectively at the inlet and the outlet of the unit and wherein, at each particular pass (x), the computer compares these effective measured values with the values of the parameters taken into account initially for the particular pass (x) in the determination of the rolling scheme, in order to review the calculation of the scheme and to add, if needed, correction factors to the parameters taken into account, in order to adapt the rolling scheme in following passes.

7. A rolling process according to claim 3, wherein the predictable value ($\sigma_1$) of the flow stress in each portion ($M_i$) of the rolling nip is determined by the computer in relation to the position in the nip of the portion considered, taking into account a temperature of metal measured before the product enters the roll stand, a deformation speed in the portion ($M_i$) considered and the evolution of the microcrystalline state of the product during the rolling operation, in previous passes and along the nip throughout the pass considered (x).

8. A rolling process according to claim 1, wherein, in order to take into account the evolution of the microcrystalline state of the metal during the rolling operation, at least one modeling equation valid for a family of metals having an analogue microcrystalline behavior is established, on a basis of hot deformation tests carried out on sample pieces of at least one typical metal of the family wherein the at least one modeling equations depend on a set of parameters associated with the composition of the at least one typical metal, the initial at least one modeling equations thus established being grafted to the mathematical model and, for rolling a product consisting of a metal of the same family as the at least one typical metal, the mathematical model is calibrated for the metal to be rolled while modifying the parameters of the modeling equations in relation to results of deformation tests performed on a metal whose composition is at least similar to the composition of the metal to be rolled.

9. A rolling process according to claim 8, wherein in order to define the modeling equations, an intermediate value is determined, associated with a deformation speed of the metal and varying the intermediate value in a relatively linear fashion in relation to the flow stress in at least one deformation domain and, on the basis of deformation tests realized for a series of deformation temperatures and speeds held constant, a work-hardening diagram is established for which the variations of said intermediate value can be represented approximately, in one of the said domains of deformation, by at least one family of straight lines to which corresponds at least one linear differential equation, associating the deformation with the flow stress and liable to be integrated by the computer.

10. A rolling process according to claim 9, wherein, on the basis of the work-hardening diagram, establishing at least two differential equations associating the deformation with the flow stress including a first equation, linear in shape, giving by analytical integration, an expression of deformation in relation to the flow stress and a second equation to be integrated digitally in order to determine the predictable flow stress corresponding to a deformation to be achieved.

11. A rolling process according to one of the claims 8 to 10, wherein the modeling equations are established on the basis of results of hot deformation tests conducted at various temperatures and at various deformation speeds held constant for each test, on a series of specimens of at least one metal whose composition is at least close to the composition of the product to be rolled.

12. A rolling process according to claim 11, wherein the modeling equations are established on the basis of hot homogeneous compression tests conducted on specimens.

13. A rolling process according to claim 11, wherein the modeling equations are established on the basis of several series of hot deformation tests conducted on several series of metal specimens having, in each series, a determined composition, wherein the compositions of the different series are chosen in order to cover a selection of metals significant of a domain of composition on which the mathematical model is calibrated, with initial different grain sizes, and wherein the tests are conducted, for each series, at different temperatures and deformation speeds significant of a stress domain on which the mathematical model is calibrated, taking into account predictable rolling conditions.

14. A rolling process according to one of the claims 8 to 10 wherein the modeling equations are established initially for a typical metal and grafted to the mathematical model and that, in order to calibrate these equations on the metal to be rolled, performing first at least one rolling pass of at least one product made up of the metal to be rolled, in at least one roll stand adjusted conventionally and in measuring, during each pass, the rolling load actually exerted and, rolling parameters used by the computer in order to determine, using initial modeling equations, the rolling load to be exerted theoretically and, using a digital regression method to determine modifications to be made to the parameters of the said initial equations in order to provide modeling equations specific to the metal to be rolled.

15. A rolling process according to claim 8, wherein, on the basis of results of deformation tests conducted each at constant temperature and at constant deformation speed, at least one deformation domain is determined for which a first modeling equation is established, linear in shape, giving an expression of variations of an intermediate function of the flow stress linked with the deformation speed and on the basis of which, by analytical integration, a second modeling equation is determined giving, in the domain an expression of the deformation in relation to the flow stress and, by digital integration reverse of said second equation, the computer determines, in relation to the deformation to be imparted and for each pass, while taking into account the rolling parameters at the inlet of the stand, the predictable value of the flow stress of the metal and determines the rolling load to be applied in order to achieve said deformation.

16. A rolling process according to claim 15, wherein, on the basis of the results of the deformation tests, a first work-hardening diagram is established, comprising a first series of representative curves, for each temperature, of a variation of a work-hardening rate $\theta=d\sigma/d\epsilon$ in relation to the flow stress $\sigma$, wherein, digital data relating to each curve of the first series is transformed to establish a second normalized work-hardening diagram comprising a second series of curves representative of the variation, in relation to a normalized running stress $\sigma^*=\sigma/\mu_{(T)}$, with an intermediate value $2\theta^*\sigma^*$ equal to twice the product of a normalized flow stress, whereas $\mu_{(T)}$ is the modulus of elastic in shear at the temperature considered, wherein each of the curves of the second series have at least a portion which is more or less rectilinear situated in at least one domain of the second diagram, and the rectilinear portions are more or less parallel in each domain, each more or less rectilinear portion is modeled according to a first equation:

$$k\sigma^*+k'=2\theta^*\sigma^*=b^2d\rho/d\epsilon$$

while using as an intermediate variable, the dislocation density in between $\rho$ such that $$\sigma=\mu b\sqrt{\rho}$$

and an analytical integration of the first equation is performed in order to establish, at least for each of the domains, a second modeling equation represented by $$\epsilon=-2/kb^2[X_s In(1-x/x_s)+x]+\lambda$$

by defining $x=b\sqrt{\rho}\sigma/\mu=\sigma^*$ and $X_s=-k/k'$, wherein $\lambda$ is an integration constant, wherein the parameters k and k' are determined, for each of the domains, on the basis of the rectilinear portion of a curve, of the second work-hardening diagram corresponding more or less to a predictable temperature of the metal and to a predictable deformation speed when entering the roll stand.

17. A rolling process according to claim 16, wherein, in each of the domains of the second work-hardening diagram, the coefficients k and k' of the first modeling equation are determined by the computer while following a digital regression method, on the basis of the temperature and of the parameters representative of the microcrystalline state of the metal when entering the roll stand.

18. A rolling process according to one of claims 15 to 17, wherein, as the rolling nip is divided into a series of successive portions $M_1$, $M_2$, . . . , $M_i$, . . . $M_p$, each corresponding to an elementary deformation ($\epsilon_i$), the computer determines before each pass, in relation to a rolling parameters measured at the inlet of the stand, the predictable flow stress ($\sigma_i$) in each portion ($M_i$) of the nip by digital integration reverse of the second modeling equation in relation to the elementary deformation ($\epsilon_i$) realized in the considered portion ($M_i$) and determines the elementary rolling load $dF_i$ to be applied in the said portion $M_i$, wherein the global rolling load is calculated by integration of the elementary loads along the nip.

19. A rolling process according to claim 1, wherein, during each rolling pass, rolling parameters are measured in order to check whether a global rolling load calculated in relation to the predictable reduction in thickness by a rolling scheme is compatible with the capacities of the unit and whether the predictable reduction in thickness uses, optimally, the capacities of the unit, wherein the computer can modify, if needed, the rolling scheme for following passes.

* * * * *